United States Patent [19]

Eckstein

[11] Patent Number: 4,467,795

[45] Date of Patent: Aug. 28, 1984

[54] BREATHING DEVICE PACKAGE

[75] Inventor: Wolfgang Eckstein, Sereetz, Fed. Rep. of Germany

[73] Assignee: Drägerwerk Aktiengesellschaft, Fed. Rep. of Germany

[21] Appl. No.: 460,999

[22] Filed: Jan. 26, 1983

[30] Foreign Application Priority Data

Feb. 23, 1982 [DE] Fed. Rep. of Germany ..... 3206483

[51] Int. Cl.[3] ..... A62B 7/00

[52] U.S. Cl. ..... 128/201.25; 128/202.13; 128/206.17

[58] Field of Search ..... 128/202.13, 206.12–206.18; 55/DIG. 33, DIG. 35

[56] References Cited

U.S. PATENT DOCUMENTS

| | | | |
|---|---|---|---|
| 3,773,043 | 11/1973 | Wachter | 128/205.29 |
| 3,944,403 | 3/1976 | Simpson et al. | 128/206.17 |
| 4,099,526 | 7/1978 | Mascher | 128/205.29 |
| 4,154,235 | 5/1979 | Warncke | 128/201.25 |

FOREIGN PATENT DOCUMENTS

| | | | |
|---|---|---|---|
| 974960 | 11/1964 | United Kingdom | 128/206.17 |
| 2030869 | 4/1980 | United Kingdom | 128/202.13 |

*Primary Examiner*—Henry J. Recla

*Attorney, Agent, or Firm*—McGlew and Tuttle

[57] ABSTRACT

A breathing device wall package suitable for a wall mounting comprises a filter container part having a gas filter with an inspiration opening and a suspended matter filter adjacent the gas filter with an air intake opening. A breathing mask, for example, a half mask is engaged on the filter container around the inspiration opening. A cover engages over the filter container part and encloses the breathing mask and includes a plug which is engageable with the air intake opening as well as the inspiration opening in order to close them when the cover is in position. When the cover is removed the openings are opened and the mask is immediately available for use.

7 Claims, 3 Drawing Figures

BREATHING DEVICE PACKAGE

FIELD AND BACKGROUND OF THE INVENTION

The invention relates in general to respirating devices and in particular to a new and useful breathing device package which makes a breathing mask readily available.

It is known that individuals are injured in fires in hotels for example. They find no mask or breathing apparatus ready to use and easily put on by untrained individuals. A known escape filter device with a protective hood is equipped with a respiratory connection in the form of a half mask fitted tightly into it. This half mask accepts a respiratory filter in the form of a CO filter. The air inlet opening is outside and the inspiration opening is inside the respiratory connection. The air inlet and inspiration openings are sealed by plugs until needed. During storage, this device is kept in a container consisting of a rear panel and a cover. The plug for the air inlet opening is fastened internally against the rear panel while the plug for the inspiration opening is fastened internally to the protective hood by a band. When the escape filter unit is removed from the container that holds it in readiness, the respiratory filter is pulled off the plugs on the rear panel thus opening the air inlet. When the protective hood is opened to place it over the head, the plug is pulled out of the inspiration opening as well. The plug, hanging on a band inside the protective hood, may cause the wearer problems. The emergency container, which encloses the entire escape filter unit, makes the device cumbersome and bulky to handle. There is no provision for testing the permanently sealed filter. (German utility model No. 80 15 449).

Another known filtered gas mask and breathing apparatus, especially a filtered escape unit for mining, is kept sealed in a container until needed. Within the container the openings of the filter are sealed off by special sealing parts additionally against the ambient air which might possibly penetrate the container. In this way, even when the covering is not completely impervious to water vapor, the penetration of moisture into the interior of the filter unit is avoided. The sealing parts, e.g. rubber plugs, fastened to the removable container, are automatically removed when the unit is taken out and the openings of the filter unit open as well. The additional containers make the filtered gas mask and breathing apparatus cumbersome; there is no provision for testing tightness (German AS No. D 3551/61a).

SUMMARY OF THE INVENTION

The invention provides a filtered gas mask and breathing apparatus which is as non-bulky as possible, can be kept reliably tight during storage, and is readily available to put on.

Accordingly it is an object of the invention to provide an improved breathing device which is suitable inter alia for mounting on a wall or similar structure which includes a filter container containing both a suspended matter filter and a gas filter which have a respective air intake opening and an inspiration opening which are closed by plugged elements of a cover which also encloses a face mask or half mask which is engaged around the inspiration opening.

Advantageously, the filter housing is simultaneously part of the holder for the device. The holder cover can be made to fit in a fashion which does not take up much room. Advantageously, it is provided internally with the space required to contain the other parts of the unit, such as the mask and hood. The connection of the plug for sealing the filter openings with the container cover ensures that they open simultaneously and also that the filtered gas mask and breathing apparatus will be ready to use if urgently needed. The test stub in the lower plug makes it possible to check the tightness of the filter container in a simple yet reliable fashion after the cap is removed. This is a safety measure preventing penetration of moisture that would damage operation.

An object of the invention is to provide a breathing device which is readily available and which includes filter elements which are already connected to a face mask and which are instantly available for use when a cover element is removed.

A further object of the invention is to provide a breathing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
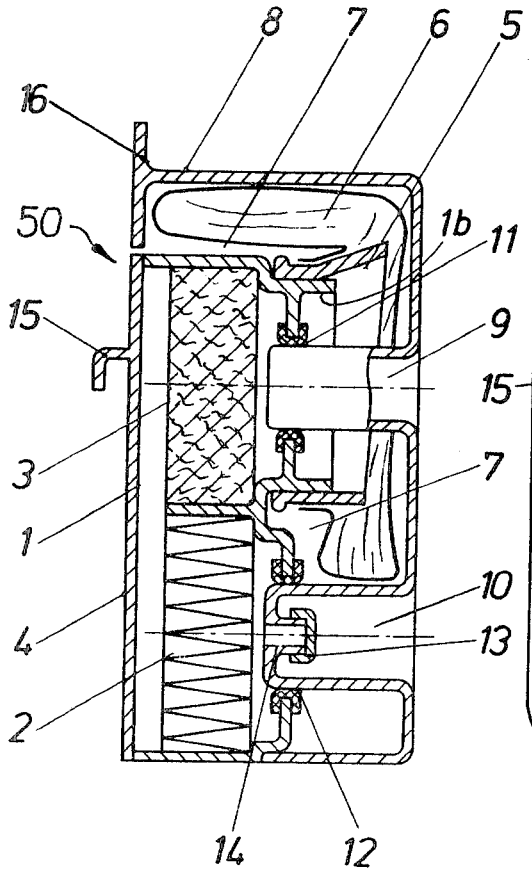
FIG. 1 is a cross sectional view of a breathing device package constructed in accordance with the invention.
Figure 2:
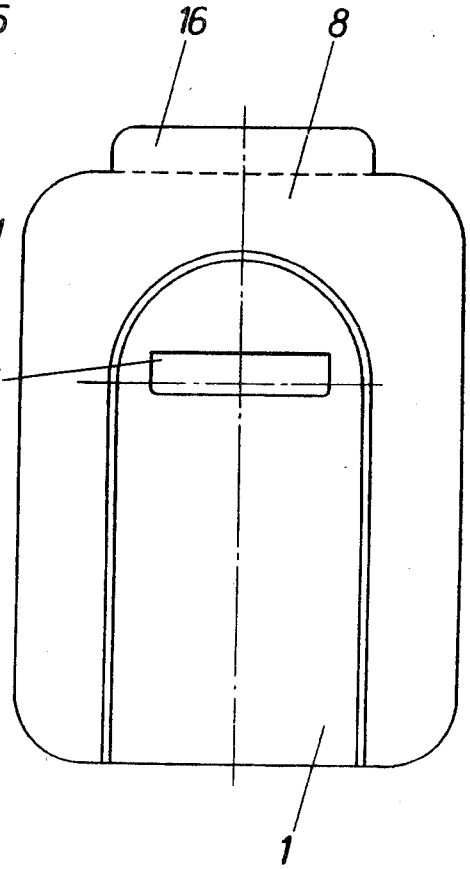
FIG. 2 is a rear elevational view of the device shown in FIG. 1.
Figure 3:
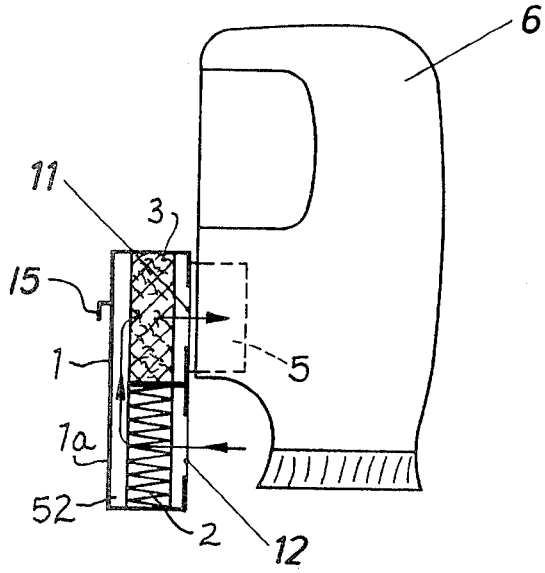
FIG. 3 is a side elevational view partly in section showing the mask in a condition of use and indicating the inspirational air flow.
Figure 3:
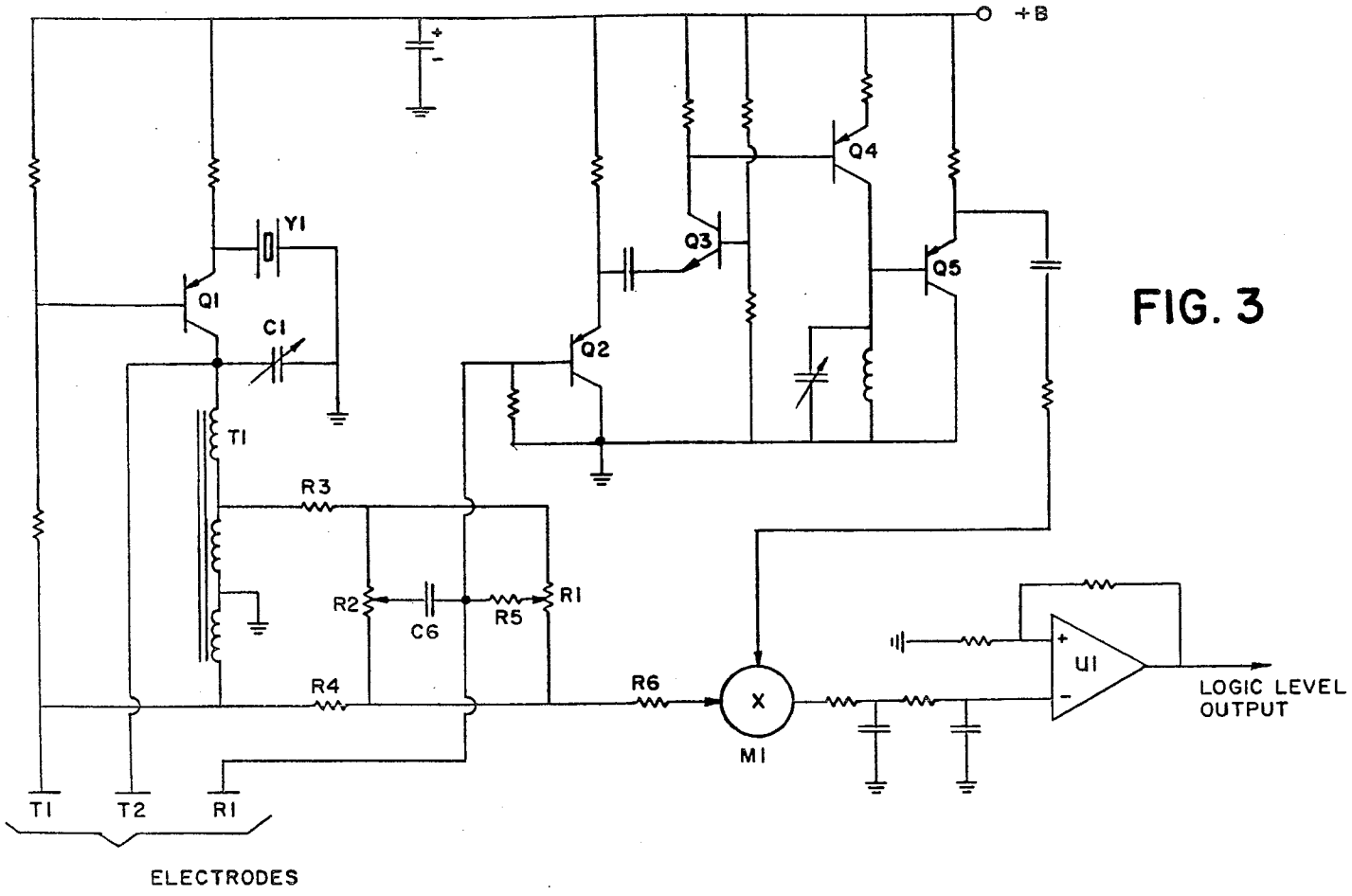

Referring to the drawings in particular the invention embodied therein comprise a breathing device package generally designated 50 which includes a filter container part 1 which comprises a container having a gas filter 3 and a suspended matter filter 2 arranged adjacent, for example, with the gas filter arranged over the suspended matter filter. The filter container includes an air intake 12 for the inflow of breathing air over the suspended matter filter and up along a passage 52 for flow through the gas filter 3 and the inspiration opening 11 into the mask 5 having a hood 6.

In accordance with the invention the filter container 1 includes a wall portion 1*a* having a hook element which permits it to be hung on a wall for example. A cover 8 is closed over the filter container 1 and also encloses the hood portion 6 of a half mask 5 which is engaged around a lip 1*b* of the container 1. In addition, in accordance with a feature of the invention the cover 8 includes plug means in the form of an upper plug 9 which engages in and closes the inspiration opening 11 and a lower plug 10 which engages in and closes the air intake 12. For testing purposes, the cap 13 may be removed from a stub portion to open the air intake partially.

Respiratory filter 1 comprises a suspended-matter filter 2 and a gas filter 3 connected downstream in the flow, in a common filter panel 4, which simultaneously serves as the bottom of the container for the unit. The respiratory connection, in this case a half mask 5, is connected tightly to gas filter 3 in known fashion. This half mask 5 can also be replaced by a mouthpiece. Half mask 5 forms part of a protective hood 6 stored in the storage compartment 7 of a container cover 8. An upper plug 9 and a lower plug 10 are formed internally on container cover 8. Upper plug 9 closes an inspiration opening 11 of gas filter 3 to half mask 5 when container cover 8 is put in place and lower plug 10 covers an air intake opening 12 of suspended matter filter 2. By making plugs 9 and 10 integral with container cover 8, filter openings 11 and 12 are forcibly opened when the cover is removed.

Lower plug 10 has a test stub 14 located inside, sealed by a cap 13. After cap 13 is removed, the tightness of respiratory filter 1 can be checked.

A grip tab 15 on the bottom of filter 4 and a grip tab 16 on container cover 8 facilitate the opening of the container and/or may serve to hang it up ready for use.

It is also known that individuals can be injured in fires, for example, in hotels. For such emergencies, a ready to use gas mask and breathing apparatus must be available at all times. A filter gas mask and breathing apparatus must be available at all times and this goal is achieved by the filtered gas mask and breathing apparatus with a container. It is a respiratory filter 1 with a mask 5 and possibly a protective hood 6 in a container for the unit. In this slightly bulky device, which is simple and reliable to use in emergencies, the filter housing simultaneously forms the bottom of the container. Container cover 8 receives mask 5 and hood 6 in a compact fashion. Plugs 9 and 10 which are required to seal filter openings 11 and 12 during storage are formed internally in container cover 8. When the container is opened, filter openings 11 and 12 open as well, so that the device is then available for use without further intervention. The filtered gas mask and breathing appratus, thanks to the design of the container, may be mounted directly where people who might possibly require protection are located, for example, on a wall.

While a specific embodiment of the invention has been shown and described in detail to illustrate the application of the principles of the invention, it will be understood that the invention may be embodied otherwise without departing from such principles.

What is claimed is:

1. A breathing device package suitable for a wall mount, comprising a filter container including mount means for mounting said container on a wall, said filter container having an air intake opening and an inspiration opening therein in side by side relationship, said container defining an air flow passage between said air intake opening and said inspiration opening, a gas filter mounted in said air flow passage adjacent said inspiration opening, a suspended matter filter mounted in said air flow passage adjacent said air intake opening, a breathing mask mounted on said filter container around said inspiration opening, a cover removably mounted onto said filter container and enclosing said breathing mask and said air intake opening, and plug means associated with said cover for closing at least one of said inspiration opening and said intake opening when said cover is engaged over said filter container.

2. A breathing device according to claim 1, wherein said plug means includes a cylindrical plug formation defined on the interior wall of said cover and extending into said inspiration opening and a separate interior plug defined on the interior wall of said cover adjacent said first plug and engaged into said intake opening.

3. A breathing device according to claim 2, wherein said second plug is located below said first plug and includes a stub portion defining a small passage through said plug and a small passage cover closing said small passage.

4. A breathing device according to claim 1, wherein said half mask comprises a respiratory connection for a wearer's face.

5. A breathing device according to claim 1, wherein said filter container includes a first wall one one side thereof and an opposite wall with said inspiration opening and said intake opening therein, said mounting means connected to said first wall.

6. A breathing device, comprising a filter container having an air intake opening and an inspiration opening therein in side by side relationship, said container defining an air flow passage between said air intake opening and said inspriation opening, a gas filter maintained in said air flow passage adjacent said inspiration opening, a suspended matter filter mounted in said air flow passage adjacent said air intake opening, a breathing mask mounted on said filter container around said inspiration opening, a cover removably mounted onto said filter container and enclosing said breathing mask and said air intake opening, and plug means associated with said cover for closing at least one of said inspiration opening and said intake opening when said cover is engaged over said filter container.

7. A breathing device according to claims 1 or 6 and further comprising a hood connected to said mask and disposed with said mask in said cover, said cover being removable to expose said hood and said mask and to remove said plugs.

* * * * *